US006386270B1

(12) United States Patent
Kandev et al.

(10) Patent No.: US 6,386,270 B1
(45) Date of Patent: May 14, 2002

(54) METHOD, SYSTEM AND APPARATUS FOR CONTINUALLY SYNCHRONIZING TRAVELLING MOVEMENT OF TWO REVOLVING EDGE DAMS IN A CONTINUOUS CASTING MACHINE

(75) Inventors: Nedeltcho P. Kandev, Quebec (CA); Jerome B. Allyn, Colchester; Dean A. Boozan, Waterville, both of VT (US)

(73) Assignee: Hazelett Strip-Casting Corporation, Colchester, VT (US)

( * ) Notice: Subject to any disclaimer, the term of this patent is extended or adjusted under 35 U.S.C. 154(b) by 0 days.

(21) Appl. No.: 09/883,880

(22) Filed: Jun. 18, 2001

(51) Int. Cl.[7] ..... B22D 11/06; B22D 27/02

(52) U.S. Cl. ..... 164/471; 164/481; 164/431; 164/507

(58) Field of Search ..... 164/431, 432, 164/471, 481, 493, 507, 513

(56) References Cited

U.S. PATENT DOCUMENTS 5,133,402 A * 7/1992 Ross ..... 164/431

* cited by examiner

*Primary Examiner*—Kuang Y. Lin

(74) *Attorney, Agent, or Firm*—G. Kendall Parmelee

(57) ABSTRACT

Method, system and apparatus for controllably heating copper alloy dam blocks in revolving edge dam chains in twinbelt continuous casters by induction heating of thermally-sprayed ferromagnetic layers bonded in shallow depressions in such blocks. High thermal conductivity of such blocks advantageously quickly conducts inductive heat from ferromagnetic layers into the blocks. For casting a slab of electrolytic anodes having aligned opposed protruding lugs, such chains include uniformly spaced lug-molding pocket blocks. Periodic induction heating of ferromagnetic layers on dam blocks of one chain or the other keeps pocket blocks aligned as revolving chains travel downstream along opposite sides of moving mold casting regions. Directly induction heating copper alloy dam blocks is very impractical. Therefore, ferromagnetic layers are thermally sprayed into depressions in blocks prior to assembling such chains. Pancake-type induction heaters inductively heat ferromagnetic layers of revolving dam blocks as they return toward a caster's entrance.

44 Claims, 6 Drawing Sheets

METHOD, SYSTEM AND APPARATUS FOR CONTINUALLY SYNCHRONIZING TRAVELLING MOVEMENT OF TWO REVOLVING EDGE DAMS IN A CONTINUOUS CASTING MACHINE

TECHNICAL FIELD OF THE INVENTION

The present invention is in the field of continuous casting of molten metal and relates to continually synchronizing the travelling movement of two revolving edge dam chains during casting in a twin belt, continuous casting machine. More particularly the invention relates to continual synchronization of travelling movement of two revolving edge dam chains having lug-molding pockets for casting aligned projecting lugs on opposite edges of a continuously cast metal slab, shown as a stream of copper anodes having opposite pairs of aligned lugs maintained in suitable alignment on their side edges.

BACKGROUND

A conventional way to mount copper anodes in an electrolytic refining tankhouse is to provide lugs projecting from opposite edges of the anodes at their upper ends for vertically hanging each anode by its lugs. It is important to have these lugs positioned in suitable alignment opposite each other. Thus, all anodes hanging in a row in a tank supported their respective lugs are vertically positioned and their edges are equally spaced from opposite sidewalls of the tank for providing a straight level row of accurately positioned, separated and aligned anodes.

It is a fairly recent development, but now conventional, to continuously cast an endless slab of anodes having their upper ends connected to lower ends of adjacent anodes. Then, downstream from the casting machine the endless slab is sheared at spaced intervals for separating individual anodes. Each anode has a pair of projecting lugs integrally cast onto its opposite edges. For the two lugs on each anode to be cast in suitable alignment with each other, it is necessary that the two revolving edge dam chains in a twin-belt, continuous casting machine have their lug-molding pockets continually synchronized in their movement along opposite edges of the casting region in the machine.

As background information, a reader of the present specification is referred to U.S. Pat. No. 4,150,711 dated Apr. 24, 1979, titled "Method and Apparatus for Continuously Casting Metal Slab, Strip or Bar with Partial Thickness Integral Lugs Projecting Therefrom" and U.S. Pat. No. 4,586,559 dated May 6, 1986, titled: "Process and Apparatus for Casting a Strip with Laterally Extending Lugs". These Patents show two revolving edge dam chains (also called "side dams") having lug-molding pockets therein in a belt-type casting machine for continuously casting an endless slab of anodes having lugs projecting from their opposite edges. These revolving edge dam chains are shown being synchronized in their travelling motion along opposite sides of the moving mold region. They are driven by friction forces of contact with the caster belts, and therefore travel at approximately the same speed as the caster belts.

A conventional way to construct such edge dam chains is to assemble a multiplicity of metal dam blocks, typically manufactured from nonmagnetic copper alloy, strung onto a flexible metal strap, for example a stainless steel strap. After the dam blocks have been strung onto the strap, the ends of the strap are joined as known in the art to form an endless loop. Such an edge dam loop also is called a "dam block chain". Being formed of metal, edge dams have a positive temperature-coefficient of thermal expansion. Thus, increasing temperature of one edge dam chain in a continuous casting machine relative to temperature of the other will slightly increase the overall length of the hotter one relative to the overall length of the less-heated one. The higher-temperature (longer) edge dam chain will require slightly more time to complete one full revolution compared with the lower-temperature (shorter) edge dam chain; for example, the longer will lag slightly behind the shorter.

The above-referenced U.S. Patents have been assigned to the same Assignee as the present patent application. Pat. No. 4,586,559 discloses controlling the relative temperatures of two revolving edge dam chains by using liquid-spray coolers and high intensity burner heaters.

A high intensity burner is a noisy, natural gas burner. Its flames are applied directly to the blocks of a revolving edge dam. Such burners exhibit many severe disadvantages.

They are extremely noisy, being stressful and detrimental to caster operating personnel, even though such personnel are wearing ear protection. Only about 20% of heat released by the intense flames of a high intensity burner goes into the dam blocks themselves. Approximately 80% of excess heat flows into spaces underneath and near the casting machine. When continuously casting an endless slab of copper anodes as shown, such casting often is carried out at a production rate reaching 100 tons per hour of "anode copper", also called "semi-pure copper". During such a casting operation, at least about one-half million (500,000) British thermal units (Btus) per hour of heat issue from the intensely-firing burners. Such heat emission occurs periodically depending on the need to change the temperature of either dam block chain relative to the other.

Thus, an enormous amount of excess heat, carried by intense flames of the burners aimed toward the edge dams, actually enters into places under and around the caster. This excess heat is very difficult to manage. It is detrimental to water seals, sensors, instrumentation, wiring, piping, crescent roller bearings, etc., and is detrimental to the environment of caster operating personnel. In summary, disadvantageously dissipating and attempting to manage at least about 500,000 Btus per hour of excess heat energy being periodically generated by intense, noisy burners is detrimental, troublesome, inefficient, and difficult to control.

SUMMARY OF THE DISCLOSURE

In accord with the present invention, there are provided method, system and apparatus enabling successful, practical, controllable, electromagnetic induction heating of nonmagnetic copper alloy edge dam blocks in edge dam chains having lug-molding pocket blocks therein. For casting a continuous slab electrolytic anodes having lugs protruding from opposite edges of the cast slab, wherein lugs on these opposite edges must be cast in aligned opposed relationship, the lug-molding pocket blocks in the two revolving edge dam chains must be kept suitably aligned with each other as they travel along opposite sides of a moving-mold casting region in a twin-belt continuous casting machine.

A thermal-sprayed layer of ferromagnetic material is applied in a shallow depression formed in top surfaces of all regular dam blocks in an edge dam chain.

An induction heater assembly is operatively associated in induction heating relation with each edge dam chain. These induction heater assemblies, as shown, include a low-friction, thin skid plate of nonferrous material. This skid plate enables top surfaces of the dam blocks (i.e., their top surfaces which are coated with and are substantially all covered by a thermal-sprayed layer of ferromagnetic material applied to all regular blocks) to slide in closely spaced relationship past an induction heater coil configured for efficiently electromagnetically coupling with the layers of ferromagnetic material on blocks of a revolving edge dam chain.

A flux concentrator is positioned close to the induction heater coil for enhancing efficient coupling of the electromagnetic field with the ferromagnetic layers on the dam blocks of the revolving edge dam chain. These ferromagnetic layers become heated by induction heating. Their heat energy is readily conducted from their relatively large surfaces into the copper alloy dam blocks.

As shown, the thin ferromagnetic layer applied into a shallow rectangular depression on each dam block covers at least about 75% of the overall area of the top surface of the dam block.

A narrow shoulder of the dam-block material surrounds the shallow rectangular depression. The ferromagnetic coating has a thickness in a range of about 0.015" (about 0.38 mm) to about 0.025" (about 0.64 mm). This ferromagnetic material is thermal sprayed within this shallow depression in a thickness whereby the resulting overall block height "H" is the same as before the depression was formed in the top surface of the block.

The novel induction heating of copper alloy dam blocks in a revolving edge dam chain provided by the method, system and apparatus disclosed advantageously is quiet and is inherently efficient because the induction heating occurs in the ferromagnetic layer on a dam block. Thereby, heat energy being provided into this layer readily is conducted into the highly thermally-conductive copper alloy material of the dam block.

Moreover, the novel induction heating assembly advantageously is cool in relation to its overall environment and provides a very precise temperature control.

BRIEF DESCRIPTION OF THE DRAWINGS

The invention, together with its further objects, features, advantages and aspects, will become more clearly understood from the following detailed description considered together with the accompanying drawings, which are arranged with emphasis for clearly illustrating features and principles of the invention. Like reference numerals indicate like elements, like components or similar functions throughout the different views.

The accompanying drawings, which are incorporated in and constitute a part of this specification, illustrate a presently preferred method, system and apparatus embodying the invention and, together with the general description set forth above and the detailed description of the preferred embodiment set forth below, serve to illustrate and explain principles and features of the invention. In these drawings:

FIG. 6 includes a showing of the thin skid plate.

FIG. 6 includes a showing of the thin skid plate.

DETAILED DESCRIPTION OF THE PREFERRED EMBODIMENT OF THE INVENTION

Figure 1:
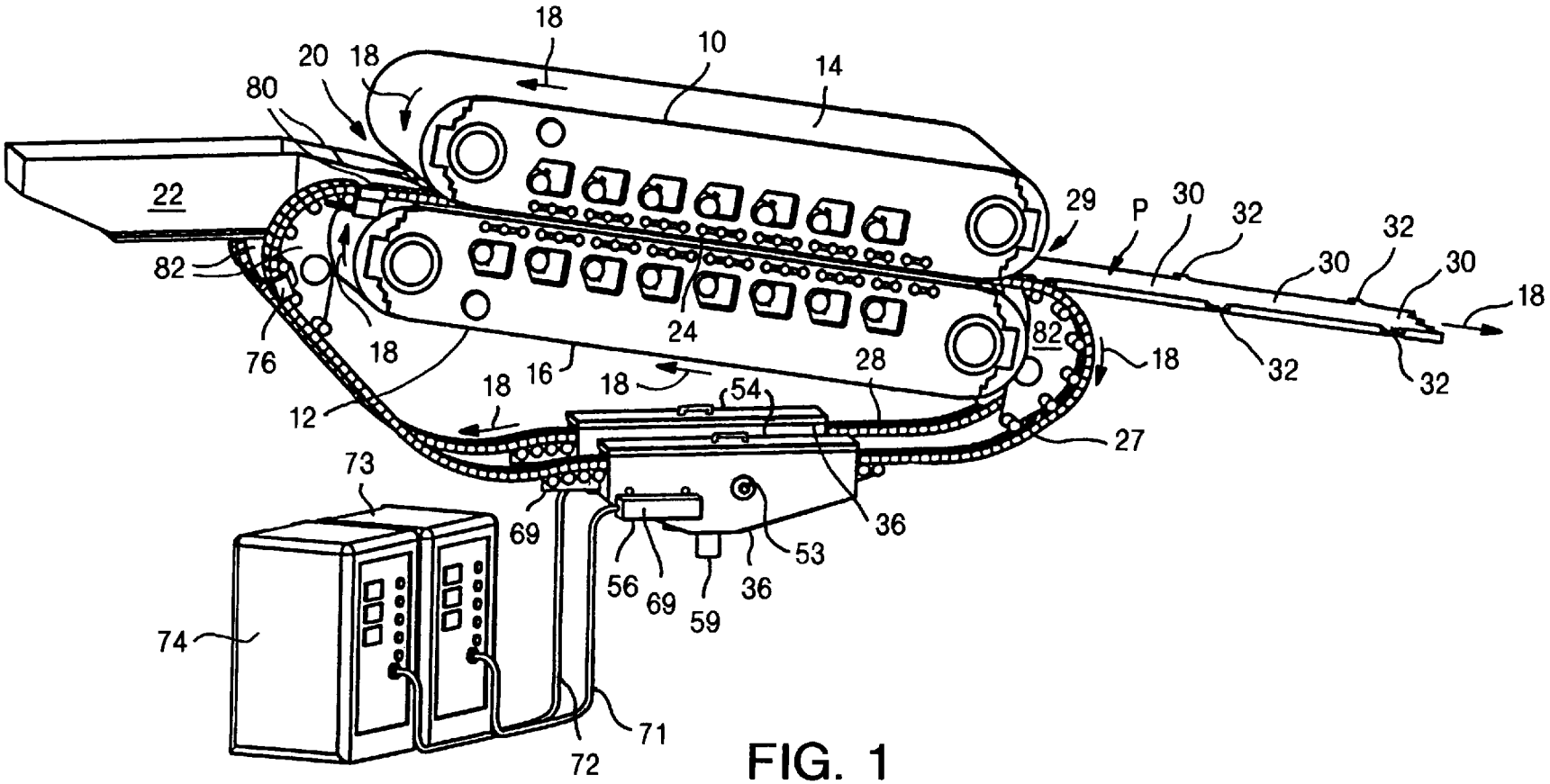
FIG. 1 is a perspective view illustrating a method, system and apparatus embodying the present invention continuously casting an endless slab of copper anodes having lugs projecting from opposite edges of each anode. A tundish feeds molten anode copper into a twin-belt-type continuous casting machine having upper and lower carriages around which are revolving upper and lower metallic casting belts. Two revolving edge dam chains each comprise a multiplicity of copper alloy dam blocks strung onto a metal strap for defining opposite sides of a moving-mold region. Lug-molding pockets are spaced at anode-length intervals along each edge dam.

FIG. 1 illustrates a method, system and apparatus embodying the present invention and setting forth the best mode contemplated by the inventors of carrying out the invention. Upper and lower carriages 10 and 12, known in the art of twin-belt continuous casting, have their respective casting belts 14 and 16 revolving, as indicated by motion arrows 18. A tundish 22 pours molten anode copper into an entrance 20 of the caster. This molten anode copper is solidified in moving-mold casting region 24 defined between upper and lower casting belts 14 and 16 (FIG. 1). Opposite sides of moving-mold casting region 24 are defined by inner surfaces 26 (FIG. 2) of first and second revolving edge dam chains 27 and 28, said chains being driven by contact with the casting belts.

A continuously cast product P issues from exit 29 of the moving-mold casting region 24. This product P is an endless slab typically about 2 inches (about 51 mm) thick and typically about 36 inches (about 914 mm) wide. This endless slab comprises a sequence of copper anodes 30 with their upper ends joined to lower ends of adjacent anodes. A downstream, slab-shearing mechanism (not shown) separates individual anodes 30 one from another. These anodes have lugs 32 projecting from opposite edges at their respective upper ends.

Figure 2:
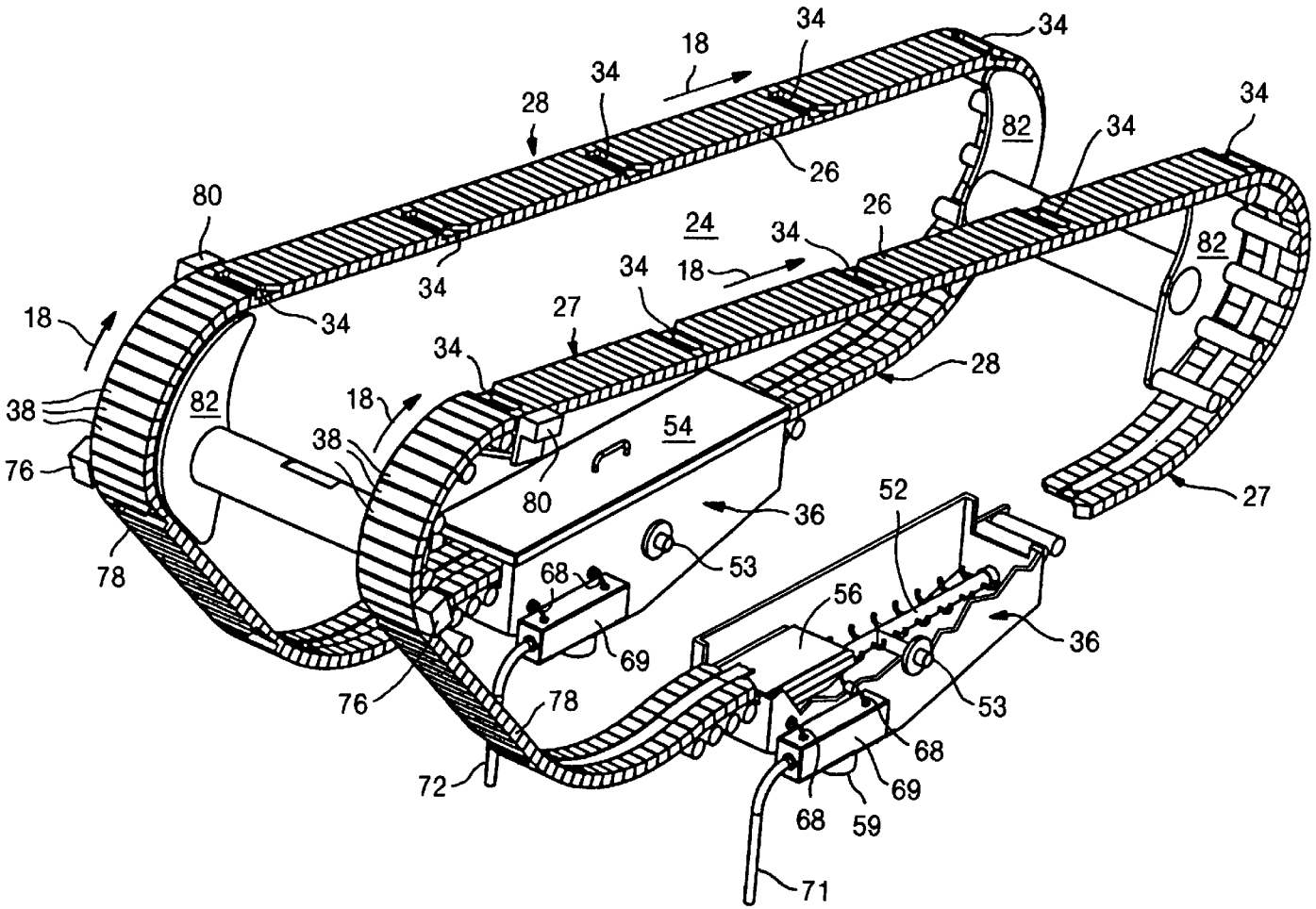
FIG. 2 is an enlarged perspective view of two revolving edge dam chains shown with associated components employed for practicing the present invention. One of two coolant spray and induction heating chambers is shown partially broken away for revealing elements within this chamber.
Figure 3:
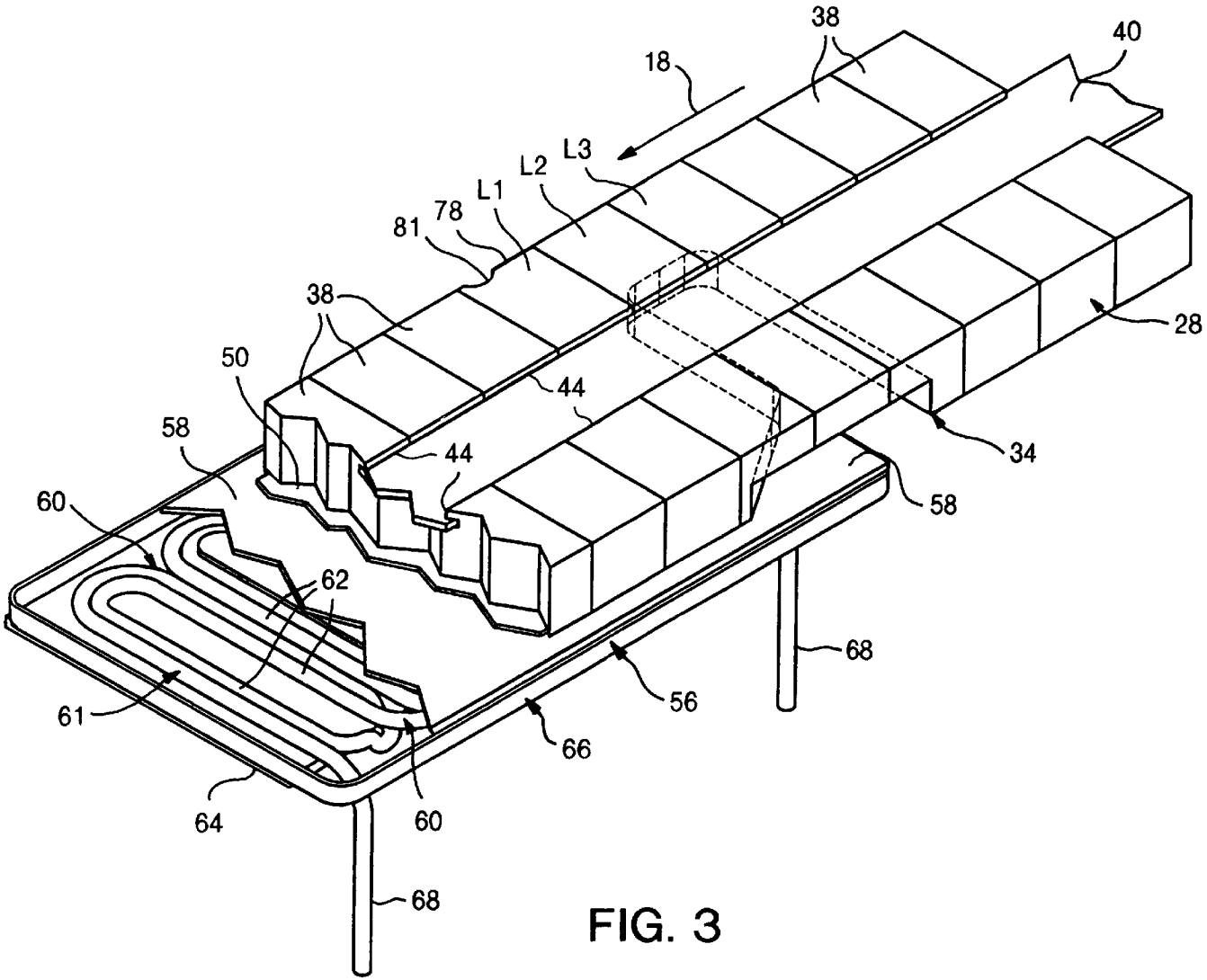
FIG. 3 is a further enlarged perspective view of a portion of a revolving edge dam chain passing over an induction heater used for heating the revolving edge dam. A thermal-sprayed layer of ferromagnetic material is shown associated with a copper alloy dam block. Such layers of ferromagnetic material applied to the copper alloy dam blocks in the edge dam chains enable efficient coupling of electromagnetic, induction-heating fields with the dam blocks. Thus, quiet, inherently efficient and cool induction heating of both revolving edge dam chains is achieved for controlling their relative lengths for synchronizing their relative rates of revolution during continuous casting, as will be explained in detail.

These pairs of lugs 32 are integrally cast together with their respective anodes 30 by means of lug pockets 34 (FIG. 2), also called "lug-molding pockets", spaced at anode-length intervals along edge dam chains 27 and 28. FIG. 3 most clearly shows a lug-molding pocket 34 in a portion of the revolving edge dam chain 28. This portion of edge dam chain 28 shown in FIG. 3 is oriented upside down relative to its orientation when travelling within the moving-mold casting region 24, because this portion of the edge dam chain is returning in direction 18 from the caster exit 29 to the caster entrance 20. Such returning portions of the revolving edge dam chains are oriented upside down, as is seen in FIGS. 1 and 2.

In order for integrally-cast lugs 32 to be positioned in suitable alignment opposite each other on side edges of their respective anodes, it is necessary that movement of respective lug pockets 34 in the two revolving edge dam chains 27, 28 be kept continually in suitable alignment directly opposite each other. This continual alignment is achieved by synchronizing positioning of the pockets 34 as they travel downstream along opposite sides of moving-mold casting region 24. Such continual control of synchronized travel of lug pockets 34 along opposite sides of casting region 24 is achieved by controlling relative temperatures of the two revolving edge dam chains. As explained above, a hotter (longer) edge dam requires more time to complete one full revolution than a cooler (shorter) one and therefore lags behind the cooler one. This control of relative temperatures of two revolving edge dams is provided by water cooling and induction heating chambers 36 having assemblies therein, to be described in detail later.

As shown most clearly in FIG. 3, each edge dam chain comprises a multiplicity of regular dam blocks 38 strung onto a suitable, flexible metal strap 40; for example, formed of stainless steel. As known in the art for stringing dam blocks 38 onto a strap 40, each block (as is shown most clearly in FIGS. 3 and 4) has a suitably-shaped groove 42 formed therein. This groove has slots extending along both sides for forming overhanging lips 44 to retain strap 40 in groove 42. The blocks 38 are formed of rugged, heat-resisting, durable copper alloy material; i.e., they are formed of suitable bronze as known and well accepted in the art. A suitable composition for such bronze dam blocks comprises 1.7–2.4% Ni, 0.5–0.9% Si, 0.2–0.4% Cr, 0.2% max Fe, and balance Cu.

Prior efforts toward direct induction heating of such edge dam chains 27 and 28 containing copper alloy dam blocks 38 have been completely stymied. The problem, using a direct induction heating, is the low electrical resistivity of this non-ferrous bronze material. The induction heating of such non-ferrous materials having low electrical resistivity (copper, bronze, etc.) presents a well known energy transfer problem. When heating these materials with a copper inductor, the amount of power transferred to the copper inductor coil itself will be almost the same as the power transferred into the "work piece". This problem that the coil itself absorbs almost the same amount of power as the "work piece" is related to the fact that the current in the coil and in the "work piece" is travelling at almost the same specific penetration depth. This penetration depth depends on the power-supply frequency and the resistivity of the metal.

We have successfully overcome these problems through the present invention which achieves efficient electrical induction heating of copper alloy dam blocks. A shallow rectangular depression 46 (FIG. 4) having rounded corners is machined into the top surfaces 48 of all regular blocks in an edge dam, i.e., in all blocks except for lug-pocket blocks. The top surface 48 (as clearly shown in FIG. 4) is opposite to a lower surface wherein is located the groove 42. In the example of edge dam chains as shown in FIG. 3, there are three lug-pocket blocks comprising three adjacent blocks L1, L2 and L3. Their upper surfaces as seen in FIG. 2 (lower surfaces as seen in FIG. 3) are machined to provide lug pockets 34. It is sometimes desirable, depending upon a particular configuration of anode lugs being cast, to provide four adjacent lug pocket blocks instead of three of them.

Figure 4:
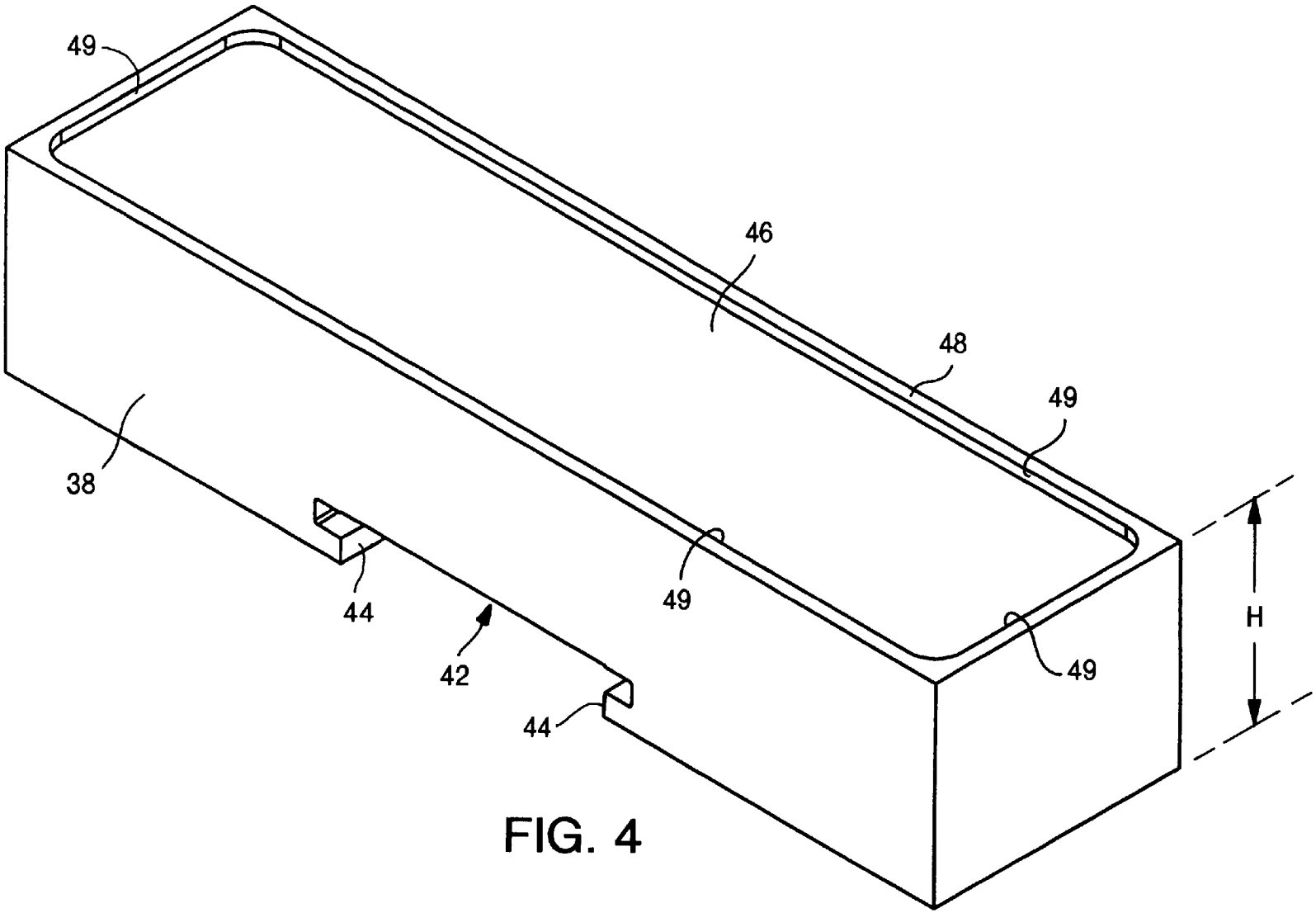
FIG. 4 is a greatly enlarged perspective view of a dam block showing a depression in an upper surface of the block for receiving into this depression a thermal-sprayed layer of ferromagnetic material.

Each shallow depression 46 as shown in FIG. 4 covers at least about 50%, and preferably covers more than about 75%, of the overall area of top surface 48 of each regular block. A narrow shoulder 49 of edge-dam-block material is retained during machining. This shoulder extends completely around each rectangular machined depression. Into these shallow depressions 46 is thermally sprayed a thin layer 50 (FIG. 3) of ferromagnetic material. This thin layer 50 is formed, for example, of ferromagnetic alloy material having a suitably high magnetic permeability and also having a suitably high electrical specific resistivity. For example, a suitable ferromagnetic alloy material is Metco 452. This alloy comprises about 53% Fe, about 38% Ni and about 10% Al. This thin coating layer 50 is applied to a thickness whereby the overall block height H (FIG. 4) is the same as before the depression 46 was machined. For example, the thickness of the resulting thin ferromagnetic layer 50 (FIG. 3) is in a range from about 0.015 of an inch to about 0.025 of an inch. To achieve suitably durable adherence of the thermally-sprayed layer 50 to the dam-block material, it is preferred that the depression 46 be grit blasted before the layer 50 is applied.

In each water cooling and induction heating chamber 36 (FIGS. 1 and 2), there is a water-coolant spray manifold 52 with an inlet connection 53. The manifold 52 has a plurality of suitable spray nozzles, as known in the art, aimed at dam blocks 38 passing through the chamber. The chambers 36 have removable access covers 54 and a spent water flow outlet 59.

Figure 7:
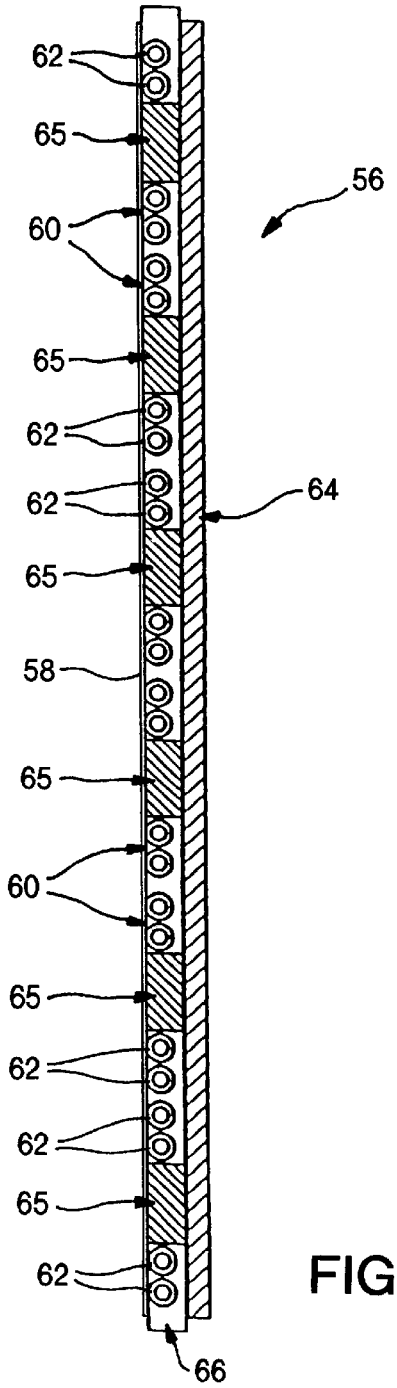
FIG. 7 shows a longitudinal sectional view of the heater assembly appearing in FIGS. 3, 5 and 6. This FIG. 7 sectional view is taken along a longitudinal plane "B"—"B" as indicated in FIG. 5.
Figure 6:
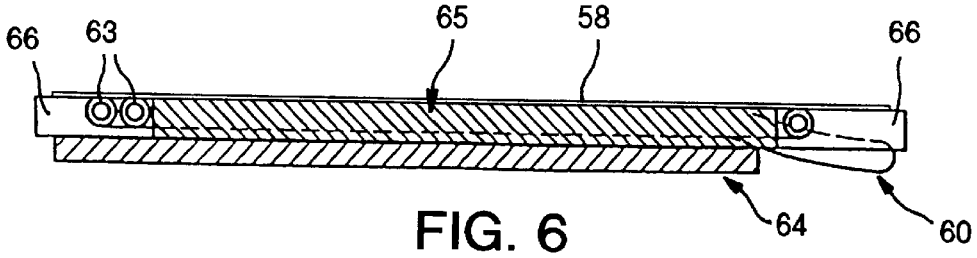
FIG. 6 is a transverse sectional view of the heater assembly shown in FIGS. 3 and 5. This FIG. 6 sectional view is taken along a transverse plane "A"—"A" as indicated in FIG. 5.

In accord with the present invention, there is installed in the outlet end of each chamber 36 an induction heater assembly 56 having a pancake-type configuration as is shown most clearly in FIGS. 3, 6 and 7. This induction heater assembly 56 includes a thin, nonferrous skid plate 58, for example formed of slippery material such as "Teflon", having a low coefficient of sliding friction. The top surfaces 48 of the dam blocks 38; i.e., their surfaces coated and substantially all covered by thermally-sprayed layer 50 of ferromagnetic material, slide over this thin skid plate. Beneath skid plate 58 are positioned induction heater coils 60. These induction coils 60 are mounted closely adjacent to the lower surface of skid plate 58 so as to be positioned at a minimal distance from the ferromagnetic layer 50 for providing efficient coupling of their electromagnetic induction field with this ferromagnetic layer.

Figure 5:
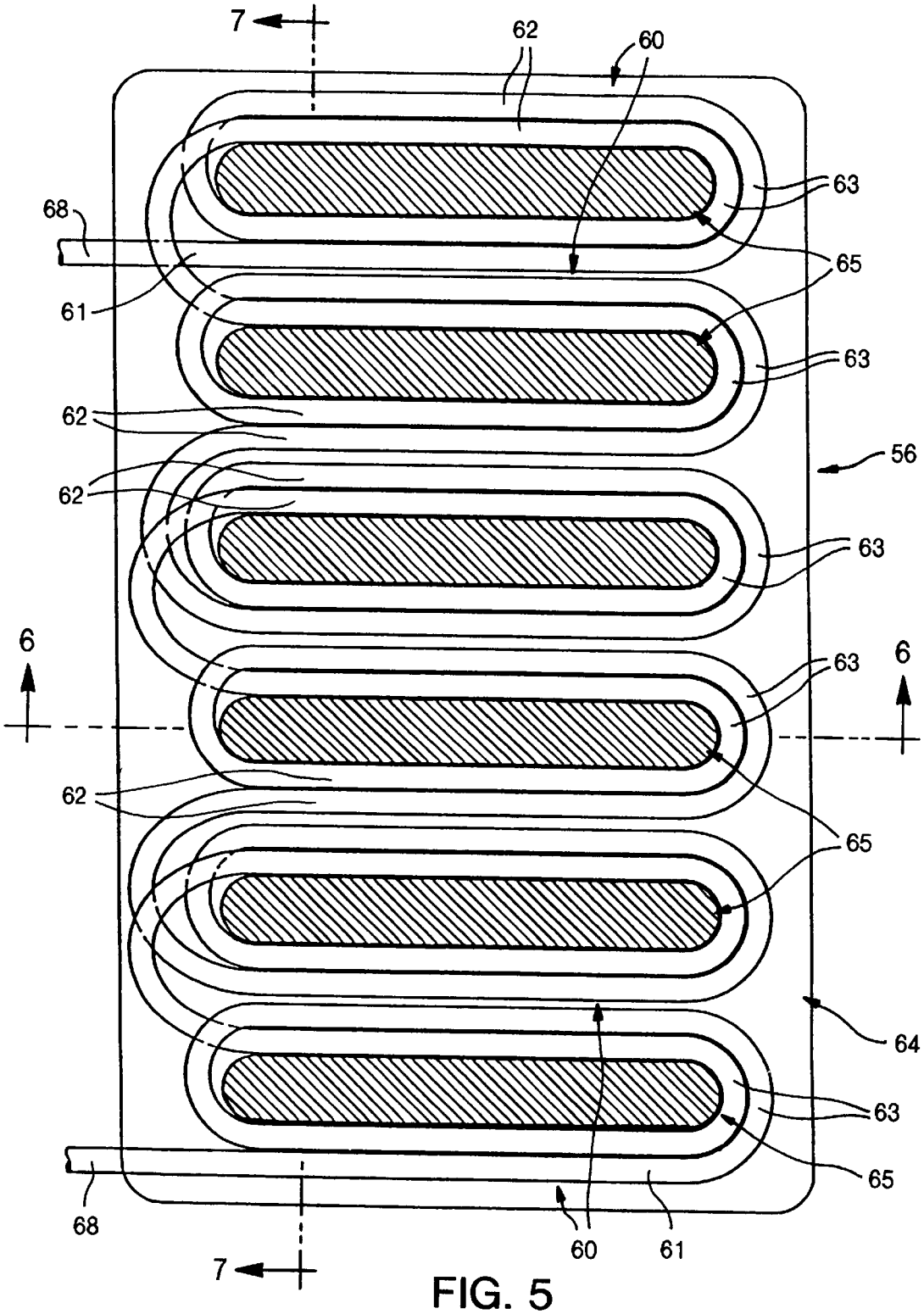
FIG. 5 is a plan view of a pancake-type induction heater assembly. For clarity of illustration, FIG. 5 omits a showing of a low-friction skid plate of nonferrous material which overlies the induction heater coils. This plan view in FIG. 5 is enlarged considerably compared with the perspective view seen in FIG. 3 of this same heater assembly.

As is shown in FIGS. 3 and 5, the induction heater coils 60 comprise an electrical conductor 61 arranged in an overall planar rectangular pattern of elongated U-shaped loops 63 having parallel legs 62 extending transversely to the direction of edge-dam travel 18. In other words, the elongated parallel legs 62 of the induction-heater conductor 61 extend transversely to the length of the moving edge dams sliding over skid plate 58.

In order to enhance coupling of the electromagnetic induction heater field generated by flow of alternating current (AC) through the conductor 61, a rectangular, planar, flux concentrator plate 64 is provided. This flux concentrator plate 64 is mounted in a plane located directly beneath and closely parallel to the planar arrangement of the elongated parallel legs 62 of conductor 61.

A plurality of elongated, oval-shaped pieces 65 (most clearly shown in FIG. 5) are support pieces around which the coils are wrapped. These support pieces 65 are made of electrically insulative material, for example such as Teflon or other suitable electrically insulative plastic material. These elongated, oval-shaped pieces 65 are closely encircled by the elongated U-shaped loops 63.

In the winding pattern of the conductor 61 shown in FIGS. 3, 5, 6, 7 and 8, there are two of the elongated loops 63 closely encircling each elongated oval-shaped piece 65.

The flux concentrator 64 is formed of high magnetic permeability, low electrical loss (i.e., high electrical specific resistivity) ferromagnetic material. An example of a suitable ferromagnetic material is Fluxtrol-B which comprises a multiplicity of ferromagnetic particles distributed in a plastic matrix. The base of induction heater assembly 56 is encapsulated in a suitable electrically-insulative, waterproof encapsulation base 66 seen most clearly in FIGS. 6, 7 and 8. An example of a suitable encapsulation material is a durable, waterproof plastic material such as CIBA GEIGY XP 3802.

In its overall pancake-type configuration, the induction heater assembly 56 comprises a two-parallel-plane sandwich structure. This sandwich structure is seen most clearly in FIGS. 6, 7 and 8. The two parallel planes are defined by the thin skid plate 58 spaced from the flux concentrator plate 64. Sandwiched between these two plates 58 and 64 are the pieces 65 encircled by their respective pairs of induction heater coils 60. The waterproof encapsulation material 66 forms a perimeter extending around the overall sandwich structure. This material 66 encapsulates peripheral portions of the induction heater coils.

Figure 8:
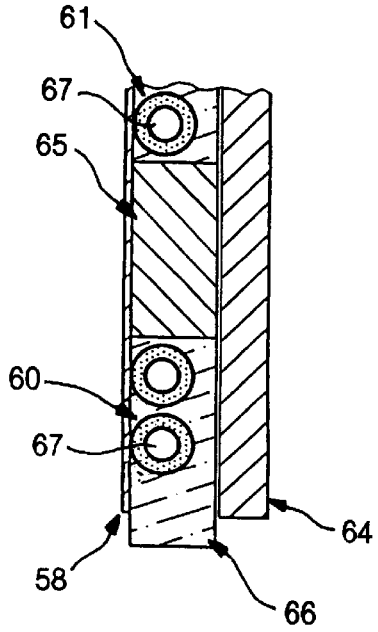
FIG. 8 shows an enlargement of a lower end portion of FIG. 7, i.e., the lower end portion of FIG. 7 as it is seen on the sheet containing FIGS. 6, 7 and 8.

As is seen most clearly in FIG. 8, the electrical conductor 61 (which is bent and shaped to form the induction heater coils 60) is hollow, having a bore 67. It is most advantageously constructed of hollow Litz cable, supplied by SKL of France. It is known in the art as a very low loss cable for such an application, and greatly improves induction coil efficiency. One configuration that can be used is size 10×5×22×0.16 mm. This designation means ten groups of cables wound around a 5 mm-O.D. copper tube with each group having five subgroups and each subgroup having 22, 0.016-mm wires. As is known in the art of induction heating, cooling water is pumped through the bore 67.

Alternating current electrical power (AC) in a range of about 20,000 Hz to about 25,000 Hz is fed into the induction coils 60 through their internally water-cooled, insulated electrical power leads 68. These leads 68 (FIG. 3) are terminated (as is indicated in FIG. 2) by extending them into a terminal housing 69 (FIGS. 1 and 2) containing suitable terminals (not shown). Within respective terminal housings 69 two AC power feed cables 71 and 72 (FIG. 1) are connected respectively to the leads 68 of the induction heater coils 60 associated with edge dam chains 27 and 28. AC cable 71 feeds power from a computer-controlled AC source 73 to the induction heater assembly 56 for heating edge dam 27. The other AC cable 72 feeds power from another computer-controlled AC source 74 to the induction heater assembly 56 for heating the other edge dam 28.

For controlling AC power sources 73 and 74 and also for controlling regulator valves, as known in the art, for regulating coolant feeding to respective spray manifolds 52, there are edge-dam temperature sensors 76 seen most clearly in FIG. 2. Such temperature sensors 76 as shown are thermocouple-type sensors, known in the art as "sliding" thermocouples (also called "contact" thermocouples). Their sensor elements are in sliding contact with outside surfaces 78 (FIG. 2) of the dam blocks. The temperature sensors 76 for edge dam chains 27 and 28, respectively, are electrically connected to respective computing and control units which control operation of AC power sources 73 and 74. Such computing and control units are described in U.S. Pat. No. 4,586,559 referenced above in Column 5, lines 49–51 as "Proportional Action-Integrating Action-Differential Action (PID)" regulators.

Further, to control AC power sources 73 and 74 and to control the spray-cooling regulator valves mentioned above, there are lug-pocket-position sensors 80. These sensors 80 are positioned near entrance 20 into moving mold casting region 24. Such lug-pocket-position sensors 80 comprise mechanical switches having suitable probes riding along outside surfaces 78 of the edge dams 27 and 28. As shown in FIG. 3, there is a crescent-shaped "lug pocket reference notch" 81 machined into the outside surface 78 of each lug-pocket block L1. Such reference notches are known in the art, for example as shown in FIG. 5 of U.S. Pat. No. 4,586,559 indicated by reference number 48 therein.

FIG. 2 shows crescent-shaped edge dam guide assemblies 82 as known in the art, having suitably positioned rollers for guiding the revolving edge dam chains immediately prior to their going into entrance 20 and immediately after their leaving exit 29.

For providing a realistic, illustrative, perspective view, FIG. 1 includes a showing of various casting-belt support and cooling components and elements, and the like. As known in the art, such components and elements are associated with upper and lower carriages 10 and 12. Since such belt carriage components and elements are so well known in the art, no need is seen to reference them and to describe them specifically herein.

It is preferred that the ferromagnetic material forming the layer 50 in the shallow depression 46 have a suitable magnetic permeability, for example the Metco 452 alloy material has a magnetic permeability of about 200 at 20° C. relative to the magnetic permeability of free space taken as one (unity). Also, it is preferred that the ferromagnetic material in layer 50 have a suitable electrical specific resistivity, for example the Metco 450 alloy material has a specific electrical resistivity of about $3.5\times10^{-6}$ ohm-meters at 20° C.

Since other changes and modifications varied to fit particular continuous casting operating requirements and environments for continuously casting endless slab products having integrally cast there with protruding suitably aligned lugs will be recognized by those skilled in the art, the invention is not considered limited to the best mode examples chosen for purposes of clear disclosure and illustration. The invention includes all changes and modifications which do not constitute a departure from the true spirit and scope of this invention as claimed in the following claims and equivalents thereto.

We claim:

1. A method for controllable electromagnetic induction heating of copper alloy edge dam blocks in first and second revolving edge dam chains of twinbelt casting machines, wherein the first and second edge dam chains include respective first and second lug-molding pocket blocks respectively positioned at uniformly spaced intervals along the first and second edge dam chains for casting continuous slabs of electrolytic anodes having first and second lugs protruding from respective first and second edges of the continuous slabs and wherein downstream of the casting machines the continuous slabs are cut for providing individual anodes, with each anode having an upper and a lower end, wherein said slabs are cut so that each individual anode has a first and a second lug protruding from the first and second edges of the anode near the upper end of the anode, wherein said first and second lugs of said anodes are used for supportively hanging the anodes in a tankhouse, and wherein respective first and second lugs on respective anodes need to be suitably aligned in opposed relationship so that anodes thereby supportively hanging in a tankhouse will be suitably aligned with other similarly supportively hanging anodes in the tankhouse:

said method of controllable electromagnetic heating of copper alloy dam blocks in first and second revolving edge dam chains in such twinbelt casting machines comprising the steps of:

providing a shallow depression in a surface of copper alloy edge dam blocks included in first and second edge dam chains in twinbelt casting machines for casting continuous slabs of electrolytic anodes having first and second lugs protruding from respective first and second edges of such continuous slabs;

said shallow depressions covering at least about 50% of said surfaces;

thermally spraying a layer of ferromagnetic material into each shallow depression;

as first and second edge dam chains are revolving in such casting machines, sensing relative opposed relationships of first and second lug-molding pocket blocks in revolving first and second edge dam chains for determining whether first or second pocket blocks are moving ahead of aligned opposed relationship relative to respective second or first pocket blocks;

providing first and second induction heaters near respective first and second edge dam chains;

said first and second induction heaters being positioned near respective first and second edge dam chains in places where such chains are returning from exits of casting machines to entrances thereof;

periodically heating copper alloy edge dam blocks in the respective edge dam chain having pocket blocks that have relatively moved ahead of said aligned opposed relationship by inductively heating ferromagnetic layers of copper alloy blocks of said respective edge dam chain for causing high thermal conductivity of the copper alloy blocks of said respective edge dam chain rapidly to conduct heat from their ferromagnetic layers into the blocks themselves;

thereby relatively thermally expanding overall length of the respective edge dam chain having pocket blocks that have relatively moved ahead of said aligned opposed relationship, whereby elapsed time is relatively increased for the relatively thermally expanded edge dam chain to travel around each full revolution for enabling the other edge dam chain to revolve in relatively less time around each full revolution for enabling its pocket blocks to re-establish said aligned opposed relationship.

2. A method claimed in claim 1, wherein:

said shallow depressions cover more than about 75% of said surfaces.

3. A method claimed in claim 2, wherein:

said shallow depressions have a bottom;

said shallow depressions have a rim extending around the bottom; and said ferromagnetic material is thermally sprayed into said shallow depressions forming a layer covering the bottom up to a level of said rim.

4. A method claimed in claim 3, wherein:

said ferromagnetic layer has a thickness in a range from about 0.015 of an inch (about 0.38 mm) to about 0.025 of an inch (about 0.64 mm).

5. A method claimed in claim 4, wherein:

said ferromagnetic material is Metco 452 ferromagnetic alloy material comprising about 53% Fe, about 38% Ni and about 10% Al.

6. A method claimed in claim 3, wherein:

said ferromagnetic layer has a magnetic permeability of at least about 100 at 20° C. relative to magnetic permeability of free space taken as one (unity).

7. A method claimed in claim 3, wherein:

said ferromagnetic layer has a preferred magnetic permeability of at least about 200 at 20° C. relative to magnetic permeability of free space taken as one (unity).

8. A method claimed in claim 3, wherein:

bottoms of said shallow depressions are grit blasted prior to thermal spraying- of ferromagnetic material therein for enhancing bonding of the layers in said shallow depressions.

9. A method claimed in claim 5, wherein:

bottoms of said shallow depressions are grit blasted prior to thermal spraying the Metco 452 ferromagnetic alloy material therein for enhancing bonding of said material in said shallow depressions.

10. A method claimed in claim 6, wherein:

said ferromagnetic layer has a specific resistivity of at least about $2\times10^{-6}$ ohm-meters.

11. A method claimed in claim 6, wherein:

said ferromagnetic layer has a specific resistivity of about $3.5\times10^{-6}$ ohm-meters.

12. A method claimed in claim 7, wherein:

said ferromagnetic layer has a specific resistivity of at least about $2\times10^{-6}$ ohm-meters.

13. A method claimed in claim 7, wherein:

said ferromagnetic layer has a specific resistivity of about $3.5\times10^{-6}$ ohm-meters.

14. A method claimed in claim 1, wherein:

said first and second induction heaters are pancake-type induction heaters;

said pancake-type induction heaters have thin, nonferrous skid plates formed of low friction slippery material; and said surfaces of the copper alloy edge dam blocks having said shallow depressions containing said thermally sprayed ferromagnetic material slide against said skid plates.

15. A method claimed in claim 14, wherein:

said copper alloy edge dam blocks include a side having a groove therein for receiving a flexible metal strap into the groove for forming the edge dam chains;

said surfaces of the copper alloy edge dam blocks wherein said shallow depressions are provided are located opposite the sides including said groove.

16. A method claimed in claim 15, wherein:

said pancake-type induction heaters each have an induction heater conductor formed into elongated U-shaped loops having pluralities of elongated parallel legs;

said elongated parallel legs of the elongated U-shaped loops of said induction heater conductor extend transversely relative to motion of the first and second edge dam chains travelling from exit to entrance of the continuous casting machines; and said elongated parallel legs are positioned immediately adjacent to a side of said thin, nonferrous skid plate opposite to the side against which the edge dam blocks are sliding for providing efficient coupling of their electromagnetic induction field with ferromagnetic layers of edge dam blocks sliding against said thin, nonferrous slippery skid plate.

17. A method claimed in claim 16, wherein:

said elongated parallel legs of the induction heater conductor extend transversely relative to travel motion of the edge dam chains; and said elongated parallel legs have a length substantially equal to an overall width of the edge dam blocks measured in a direction transverse to the travel motion of the edge dam chains.

18. A method claimed in claim 17, wherein:

said pancake-type induction heaters have a flux concentrator plate positioned in spaced parallel relationship to said thin, nonferrous, slippery skid plate;

said elongated U-shaped loops of the induction heater conductor each comprise two turns of said conductor wound around elongated, oval-shaped, winding-support pieces made of electrically insulative material; and said elongated, oval-shaped winding-support pieces are sandwiched between said thin, nonferrous, slippery skid plate and said flux concentrator plate.

19. A method claimed in claim 18, wherein:

said flux concentrator plate is formed of high magnetic permeability, high electrical specific resistivity ferromagnetic material.

20. A method claimed in claim 19, wherein:

said induction heater conductor is formed from a hollow Litz cable of the type supplied by SKL of France; and cooling water is pumped through a bore of the hollow Litz cable.

21. A method claimed in claim 19, wherein:

said induction heater conductor is energized by alternating current electrical power having a frequency in a range from about 20,000 Hz to about 25,000 Hz.

22. A method claimed in claim 20, wherein:

said induction heater conductor is energized by alternating current electrical power having a frequency in a range from about 20,000 Hz to about 25,000 Hz.

23. A system for controllable induction heating of copper alloy dam blocks in first and second revolving edge dam chains of a twinbelt continuous casting machine, wherein said first and second edge dam chains include respective first and second multiplicities of copper alloy edge dam blocks, each of said edge dam blocks of said first and second multiplicities has a strap-receiving groove therein, and said respective first and second pluralities of edge dam blocks are strung on respective first and second flexible metal straps extending through said grooves, said system comprising:

a shallow depression in a surface of each copper alloy edge dam block of said first and second multiplicities of edge dam blocks;

said shallow depression covering at least about 50% of each said surface;

a layer of ferromagnetic material in each shallow depression;

first and second induction heaters positioned adjacent to the respective first and second edge dam chains in places where said chains are returning from an exit of the casting machine to an entrance thereof;

said first and second induction heaters including first and second nonferrous slippery skid plates each having a low coefficient of sliding friction;

said first and second skid plates being formed of electrically resistive material;

said surfaces of the edge dam blocks having said layer of ferromagnetic material in said shallow depression being oriented for sliding contact with said skid plates;

first and second edge-dam temperature sensors being positioned for sensing temperatures of the respective edge dam blocks of said first and second pluralities of edge dam blocks;

first and second computer-controlled AC electrical power sources connected to the respective first and second induction heaters; and said first and second temperature sensors having control relationship with the respective first and second computer-controlled AC electrical power sources for controlling induction heating of the respective copper alloy dam blocks in the respective first and second edge dam chains.

24. The system claimed in claim 23, wherein:

said shallow depressions are formed in top surfaces of said edge dam blocks;

said top surfaces are opposite lower surfaces of the edge dam blocks; and said top surfaces being oriented for sliding contact with said skid plates.

25. The system claimed in claim 24, wherein:

said shallow depressions cover more than about 75% of said top surfaces.

26. The system claimed in claim 23, wherein:

each shallow depression has a bottom;

each shallow depression has a rim encircling said bottom;

each said rim has a top; and the ferromagnetic layer in each said shallow depression fills the depression to a level even with the top of said rim.

27. The system claimed in claim 25, wherein:

said bottom of each shallow depression is grit blasted; and the ferromagnetic layer in each shallow depression is bonded to the grit blasted bottom of the depression.

28. The system claimed in claim 27, wherein:

the ferromagnetic layer in each shallow depression is thermally sprayed into the shallow depression.

29. The system claimed in claim 27, wherein:

said ferromagnetic layer has a thickness in a range from about 0.015 of an inch (about 0.38 mm) to about 0.025 of an inch (about 0.64 mm).

30. The system claimed in claim 28, wherein:

said ferromagnetic layer has a thickness in a range from about 0.015 of an inch (about 0.38 mm) to about 0.025 of an inch (about 0.64 mm).

31. The system claimed in claim 30, wherein:

said ferromagnetic material is Metco 452 ferromagnetic alloy material comprising about 53% Fe, about 38% Ni and about 10% Al.

32. The system claimed in claim 23, wherein:

said ferromagnetic layer has a magnetic permeability of at least about 100 at 20° C. relative to magnetic permeability of free space taken as one (unity).

33. The system claimed in claim 23, wherein:

said ferromagnetic layer has a preferred magnetic permeability of at least about 200 at 20° C. relative to magnetic permeability of free space taken as one (unity).

34. The system claimed in claim 32, wherein:

said ferromagnetic layers have a specific resistivity of at least about $2\times10^{-6}$ ohm-meters.

35. The system claimed in claim 32, wherein:

said ferromagnetic layers have a specific resistivity of about $3.5\times10^{-6}$ ohm-meters.

36. The system claimed in claim 33, wherein:

said ferromagnetic layers have a specific resistivity of at least about $2\times10^{-6}$ ohm-meters.

37. The system claimed in claim 33, wherein:

said ferromagnetic layers have a specific resistivity of about $3.5\times10^{-6}$ ohm-meters.

38. The system claimed in claim 24, wherein:

said first and second induction heaters are pancake-type induction heaters;

said pancake-type induction heaters have respective first and second induction heater conductors formed into elongated U-shaped loops having pluralities of elongated parallel legs;

said elongated parallel legs of the elongated U-shaped loops of said first and second induction heater conductors extend transversely relative to motion of the respective first and second edge dam chains travelling from exit to entrance of the continuous casting machines;

said elongated parallel legs are positioned immediately adjacent to a side of the respective first and second thin, nonferrous skid plates opposite to the side against which the top surfaces of the edge dam blocks are oriented for sliding contact for providing efficient coupling of their electromagnetic induction field with ferromagnetic layers in top surfaces of the edge dam blocks; and said elongated parallel legs have a length substantially equal to an overall width of the top surfaces of the edge dam blocks measured in a direction transverse to the motion of the edge dam chains in their travel from the exit to the entrance of the machine.

39. The system claimed in claim 38, wherein:

said first and second induction heater conductors are formed from hollow Litz cable of the type supplied by SKL of France; and cooling water is pumped through a bore of the hollow Litz cables.

40. The system claimed in claim 39, wherein:

said first and second computer-controlled AC electrical power sources energize the respective first and second induction heater conductors by alternating current electrical power having a frequency in a range from about 20,000 Hz to about 25,000 Hz.

41. Apparatus for controllable heating of copper alloy edge dam blocks in first and second revolving edge dam chains of a twinbelt continuous casting machine, wherein the first and second revolving edge dam chains travel from an exit of the machine to an entrance of the machine and the first and second revolving edge dam chains pass through respective first and second chambers during their travel from exit to entrance of the machine, wherein said first and second chambers include respective first and second liquid coolant spray manifolds having respective first and second pluralities of spray nozzles aimed at edge dam blocks passing through the respective chambers, wherein first and second temperature sensors are positioned for sensing temperatures of edge dam blocks in the respective first and second edge dam chains subsequent to passage of the edge dam blocks through the respective first and second chambers and prior to arrival of the edge dam blocks at the entrance of the machine; and wherein said first and second temperature sensors are in control relationship with respect to flow of liquid coolant into said first and second manifolds for controlling coolant sprays issuing from the respective first and second pluralities of spray nozzles, said apparatus comprising:

first and second pancake-type induction heaters mounted in the respective first and second chambers;

said first and second pancake-type induction heaters having respective first and second nonferrous slippery skid plates formed of electrically resistive material having a low coefficient of sliding friction;

said first and second skid plates being positioned for sliding contact with top surfaces of the edge dam blocks of the respective first and second edge dam chains subsequent to passage of the edge dam blocks past the respective first and second spray nozzles;

a layer of ferromagnetic material covering at least about 50% of the top surfaces of edge dam blocks in the respective first and second edge dam chains;

first and second computer-controlled AC electrical power sources connected to the respective first and second pancake-type induction heaters for energizing the respective first and second pancake-type induction heaters; and said first and second temperature sensors are in control relationship with the respective first and second computer-controlled AC electrical power sources for controlling electrical energization of the respective first and second pancake-type induction heaters for controlling temperatures of the edge dam blocks subsequent to passage of the edge dam blocks past the respective first and second spray nozzles.

42. Apparatus claimed in claim 41, wherein:

said first and second computer-controlled AC electrical power sources energize the respective first and second pancake-type induction heaters by alternating current electrical power having a frequency in a range from about 20,000 Hz to about 25,000 Hz.

43. Apparatus as claimed in claim 42, wherein:

said ferromagnetic layers cover at least about 75% of the area of the top surfaces of the edge dam blocks.

44. Apparatus as claimed in claim 43, wherein:

said first and second pancake-type induction heaters contain respective first and second induction heater conductors formed from a hollow Litz cable of the type supplied by SKL of France; and cooling water is pumped through a bore of the hollow Litz cables.

* * * * *